US005678745A

United States Patent [19]

Yoshie

[11] Patent Number: 5,678,745

[45] Date of Patent: Oct. 21, 1997

[54] ABNORMALITY-IN-STAPLING DETECTING MECHANISM OF ELECTRIC STAPLER

[75] Inventor: Toru Yoshie, Tokyo, Japan

[73] Assignee: Max Co., Ltd., Tokyo, Japan

[21] Appl. No.: 596,582

[22] Filed: Feb. 5, 1996

[30] Foreign Application Priority Data

Feb. 3, 1995 [JP] Japan ..... 7-039163

[51] Int. Cl.[6] ..... B25C 7/00

[52] U.S. Cl. ..... 227/4; 227/155

[58] Field of Search ..... 227/2, 4, 155, 227/156, 131

[56] References Cited

U.S. PATENT DOCUMENTS

| | | | |
|---|---|---|---|
| 4,546,910 | 10/1985 | Logtens | 227/155 |
| 5,133,493 | 7/1992 | Russel et al. | 227/155 |
| 5,516,025 | 5/1996 | Erikson | 227/155 |
| 5,586,710 | 12/1996 | Golicz | 227/155 |

FOREIGN PATENT DOCUMENTS

| | | |
|---|---|---|
| 58-173629 | 9/1983 | Japan . |
| 60-64802 | 4/1985 | Japan . |

*Primary Examiner*—Scott A. Smith

*Attorney, Agent, or Firm*—Jacobson, Price, Holman & Stern, PLLC

[57] ABSTRACT

A detecting mechanism of an electric stapler is provided for detecting an abnormal state in which sheets (2) of paper are not normally fastened together with staples (3). The detecting mechanism comprises a stapling base (1) on which sheets (2) of paper are laid and which has a space for receiving the ends (3*b*) of legs (3*a*) of a staple (3) which have been driven through the sheets, a pair of clinchers (6A, 6B) rotatably mounted under the receiving space, and a driver (8) for rotating each of the clinchers (6A, 6B) in a predetermined direction so as to press and clinch the ends (3*b*) of the legs (3*a*). The clinchers (6A, 6B) are each rotated in a direction opposite to the predetermined direction when the legs (3*a*) of the staple (3) have been driven through the sheets (2). The detecting mechanism is provided with a photosensor (12) for detecting the rotation of the clinchers (6A, 6B) when the clinchers (6A, 6B) are each rotated in the opposite direction.

5 Claims, 4 Drawing Sheets

ABNORMALITY-IN-STAPLING DETECTING MECHANISM OF ELECTRIC STAPLER

BACKGROUND OF THE INVENTION

1. Field of the Invention

This invention relates to a detecting mechanism of an electric stapler for detecting an abnormal state in which sheets of paper are not normally fastened together with a staple or staples.

2. Description of the Related Art

Generally, an electric stapler of a built-in type used within a copying machine is actuated in accordance with control signals output by the copying machine. For this reason, regardless of a state in which staples discharged from the stapler are not normally driven through layers of paper to hold them together, the stapler continues the stapling operations in accordance with control signals output by the copying machine until there are produced a fixed number of pamphlets or booklets each of which is made by fastening the layers together. As a result, disadvantageously, cases occur in which many pamphlets inferior in stapling are produced or many staples unremovably stop up a portion of the stapler from which staples are discharged. As a countermeasure against it; there has been proposed an idea that the copying machine is provided with a detecting mechanism for ascertaining whether stapling has been normally carried out or not. However, due to various sizes of sheets of paper to be fastened together or an unfixed place at which the sheets are placed according to the size of the sheets, a plurality of stationary sensors and movable sensors are required, and thus the cost of production is raised.

Accordingly, another idea has been proposed that the built-in stapler is provided with such a detecting mechanism. In this mechanism, a clincher and legs of a staple are designed to be brought into contact with each other and, when they come in contact with each other, a switch is turned on to send out a detection signal of a normal state of fastening together. However, according to this mechanism, disadvantageously, the normal-state signal is sent out even when a hole of a stapler through which staples are discharged is plugged with staples, a staple discharging action of the stapler is carried out without a staple, or the legs of a staple are each bent in an opposite direction.

Further, according to the mechanism, cases frequently occur in which the normal-state signal is not sent out contrary to the fact that stapling has been normally carried out in a state of a driven staple being in contact with the clincher, because an adhesive agent used to stick staples together is an insulation and the surface of each staple is covered with the adhesive agent. Further, if an arrangement is adopted in which the normal-state signal is given by bringing the legs of a staple into contact with a pair of clinchers, respectively, it is necessary to insulate the clinchers from each other because of movement of the clinchers contiguous to each other. Accordingly, restrictions are placed on the construction of the mechanism.

SUMMARY OF THE INVENTION

It is an object of the present invention to provide a detecting mechanism mounted in an electric stapler which is capable of always and correctly detecting a state where stapling is abnormally carried out and is capable of being manufactured at low cost.

An abnormality-in-stapling detecting mechanism of an electric stapler according to the present invention comprises a stapling base on which sheets of paper are laid, a pair of movable clinchers rotatably mounted under an opening formed in the stapling base, and a driver for rotating each of the clinchers in a predetermined direction so as to press and clinch ends of legs of a staple. The opening receives the ends of the legs which have been driven through the sheets. The clinchers are each rotated in a direction opposite to the predetermined direction when the ends of the leas have been driven through the sheets. A detecting means is provided for detecting the rotation of the clinchers when the clinchers are each rotated in the direction opposite to the predetermined direction.

DETAILED DESCRIPTION OF THE EMBODIMENT

An embodiment of the present invention will he described with reference to the attached drawings.

Figure 1:
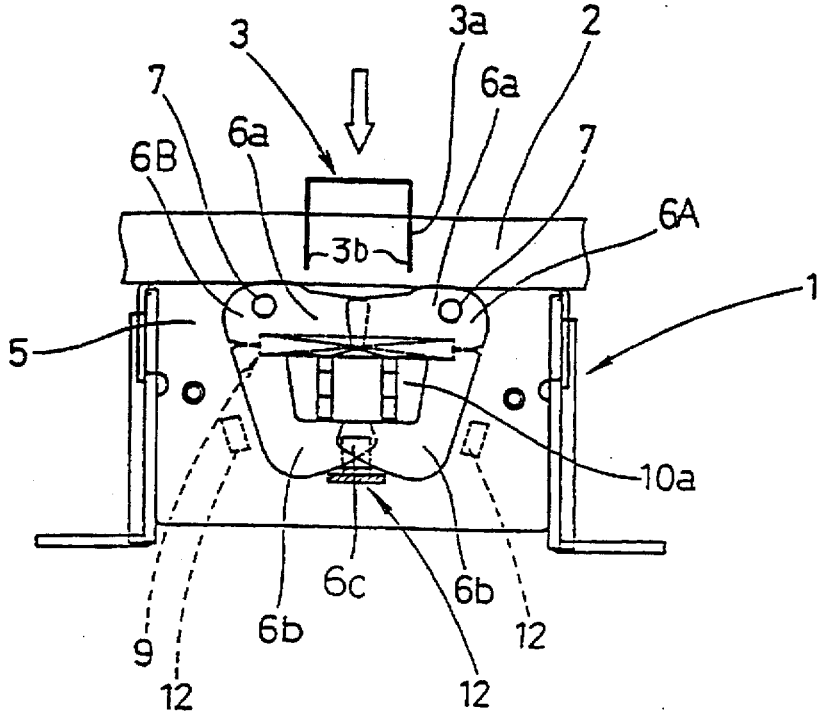
FIG. 1(*a*) is a front view of an abnormality-in-stapling detecting mechanism of an electric stapler according to the present invention, and FIG. 1(*b*) is a side view of FIG. 1(*a*).
Figure 1:
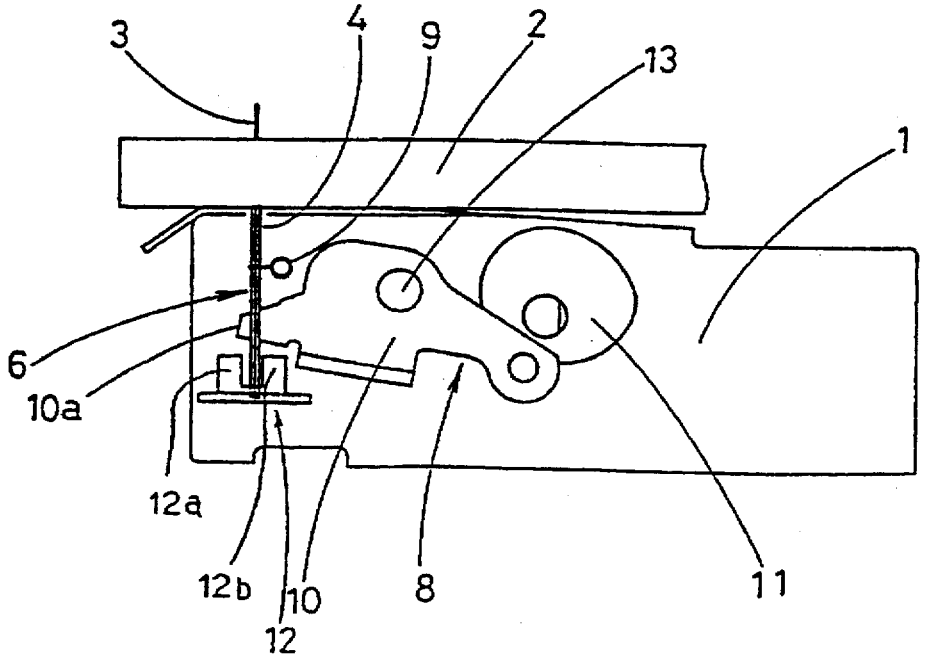

FIGS. 1(*a*) and 1(*b*) each show an abnormality-in-stapling detecting mechanism of an electric stapler. Reference numeral 1 designates a stapling base. Sheets 2 of paper to be fastened together are laid on the stapling base 1. In the stapling base 1, an opening 4 is formed for receiving the ends 3*b* of legs 3*a* of a staple 3 which have been driven through the sheets 2. A supporting plate 5 (not shown) is fixedly mounted under the opening 4. Shafts 7 are mounted on the supporting plate 5. A pair of movable clinchers 6A, 6B are rotatably attached to the shafts 7, 7, respectively. Behind the clinchers 6A, 6B, a driver 8 is disposed for rotating the clinchers 6A, 6B in predetermined directions (i.e., clockwise and counterclockwise, respectively). The clinchers 6A, 6B are each made up of a horizontal pressing part 6*a* situated under the opening 4 and a hook-shaped part 6*b* extending from the pressing part 6*a* downward. The clinchers 6A, 6B are each formed substantially C-shaped by the two parts 6*a*, 6*b*. The clinchers 6A, 6B are pulled toward each other by means of a spring 9. The clinchers 6A, 6B overlap at the ends 6*c* of the hook-shaped parts 6*b*.

The pressing parts 6*a* are arranged such that the ends 3*b* of the legs 3*a* of the staple 3 ere brought into contact with the respective surfaces of the pressing parts 6*a* when the legs 3*a* have been driven through the sheets 2.

The driver 8 comprises a driving link 10 and a cam 11 rotated by a driving mechanism (nut shown). The driving link 10 is rotated on a rotating shaft 13 mounted in the middle of the driving link 10, so that a front part 10*a* of the driving link 10 makes an up-and-down movement. The front part 10*a* of the driving link 10 is situated under the pressing parts 6*a* of the clinchers 6A, 6B, whereas a rear part 10*b* of the driving link 10 is engaged with an outer surface of the cam 11.

The rotation of the cam 11 by the driving mechanism (not shown) brings about the rotation of the driving link 10, thereby bringing about the up-and-down movement of the front part 10*a* of the driving link 10.

A reciprocative driver, a driving unit for reciprocating the driver, a magazine for staples 3, etc., (each not shown) are mounted over the stapling base 1. According to the reciprocation of the driver, the staple 3 is driven into and through the sheets 2.

A photosensor 12 is mounted under the opening 4 of the stapling base 1. The photosensor 12 comprises a light emitting diode 12*a* and a photodiode 12*b* which are arranged such that the ends 6*c* of the hook-shaped parts 6*b* of the clinchers 6A, 6B are placed between the light emitting diode 12*a* and the photodiode 12*b*. The photodiode 12*b* serves to receive a beam of light emitted by the light emitting diode 12*a*. When the clinchers 6A, 6B are not rotated (i.e., the clinchers 6A, 6B are in a state shown in FIG. 1), the ends 6*c* of the hook-shaped parts 6*b* intercept the beam of light from the light emitting diode 12*a*.

The driver 8 is actuated on the condition that the photodiode 12*b* has output a light-reception signal.

Action in the above embodiment will now be described.

Figure 2:
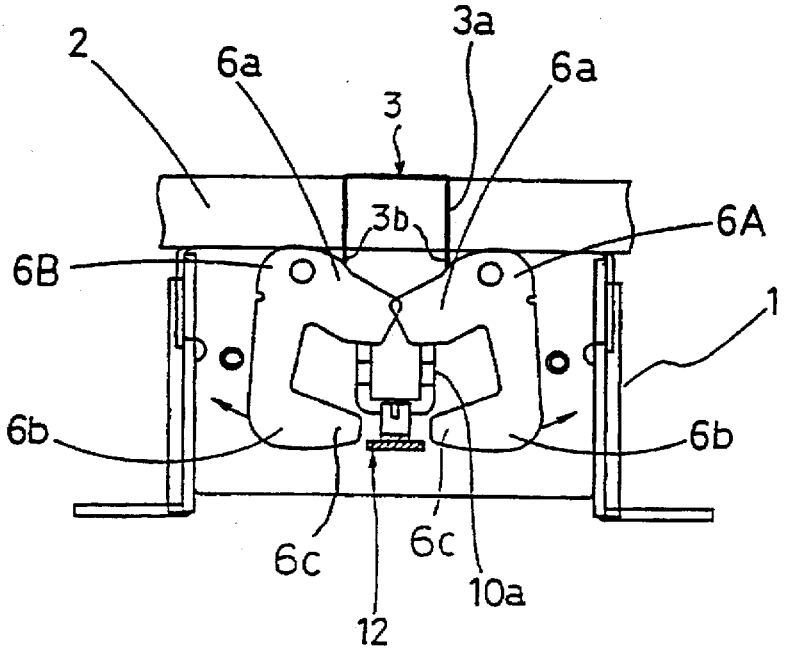
FIG. 2(*a*) is a front view of the detecting mechanism which is working, and FIG. 2(*b*) is a side view of FIG. 2(*a*).
Figure 2:
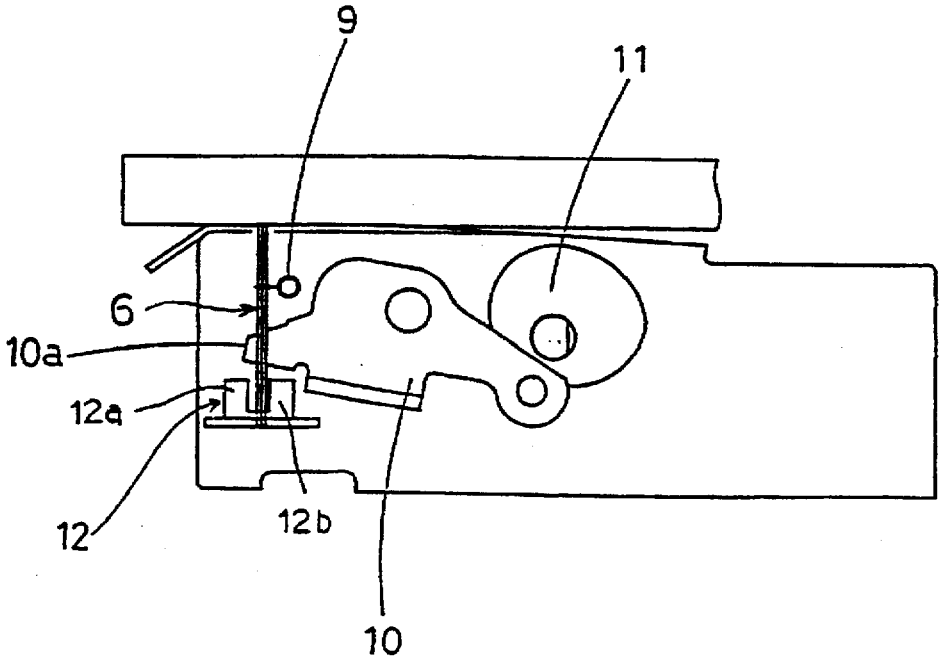

The driver (not shown) is actuated and, as shown in FIG. 1(*a*), the legs 3*a* of the staple 3 are driven into the sheets 2. When the legs 3*a* have been driven through the sheets 2, the ends 3*b* of the legs 3*a* enter the opening 4 and come in contact with the respective surfaces of the pressing parts 6*a* of the clinchers 6A, 6B so as to push the pressing parts 6*a*, as shown in FIG. 2(*a*). By the push, the clinchers 6A, 6B are rotated against the force of the spring 9 in a direction opposite to a predetermined direction. In other words, when the legs 3*a* of the staple 3 have been normally driven through the sheets 2, the clincher 6A is rotated counterclockwise whereas the clincher 6B is rotated clockwise.

When the clinchers 6A, 6B are each rotated in the direction opposite to the predetermined direction, the ends 6*c* of the hook-shaped parts 6*b* of the clinchers 6A, 6B are separated from each other to release the interception of the beam of light emitted by the light emitting diode 12*a*, as shown in FIG. 2(*a*).

In other words, when the legs 3*a* have been normally driven through the sheets 2, the photosensor 12 detects that the legs 3*a* have been normally driven through the sheets 2.

Figure 3:
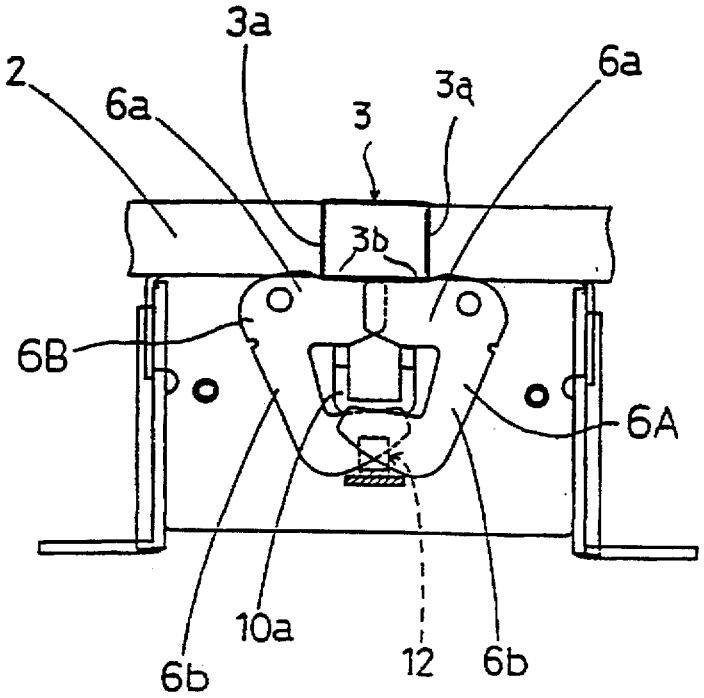
FIG. 3(*a*) is a front view of the detecting mechanism which is working, and FIG. 3(*b*) is a side view of FIG. 3(*a*).
Figure 3:
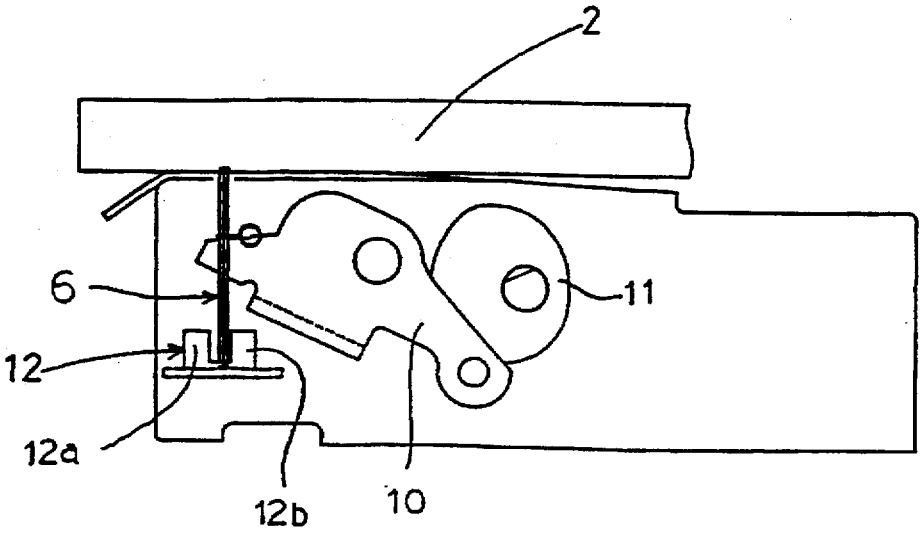

According to the detection, the driver 8 is actuated to rotate the cam 11. According to this rotation of the cam 11, the driving link 10 is rotated to move the front part 10*a* thereof upward as shown in FIGS. 3(*a*) and 3(*b*) and thereby the clinchers 6A, 6B are each rotated in the predetermined direction.

In other words, the clincher 6A is rotated clockwise whereas the clincher 6B is rotated counterclockwise. According to these rotations, the pressing parts 6*a* of the clinchers 6A, 6B are moved upward. Since the ends 3*b* of the legs 3*a* of the staple 3 are in contact with the surfaces of the pressing parts 6*a*, 6*a*, respectively, the ends 3*b* of the legs 3*a* are pressed and bent inward as the pressing parts 6*a* are moved upward. As a result, the ends 3*b* of the legs 3*a* are clinched, and the stapling is completed.

When the front part 10*a* of the driving link 10 reaches a top dead point, the ends 6*c* of the hook-shaped parts 6*b* again intercept the beam of light emitted by the light emitting diode 12*a*. After that, the front part 10*a* of the driving line 10 returns to an initial position (shown in FIGS. 1(*a*) and 1(*b*)) a little below the top dead point and, for next stapling, the clinchers 6A, 6B also return to an initial position shown in FIGS. 1(*a*) and 1(*b*).

Figure 4:
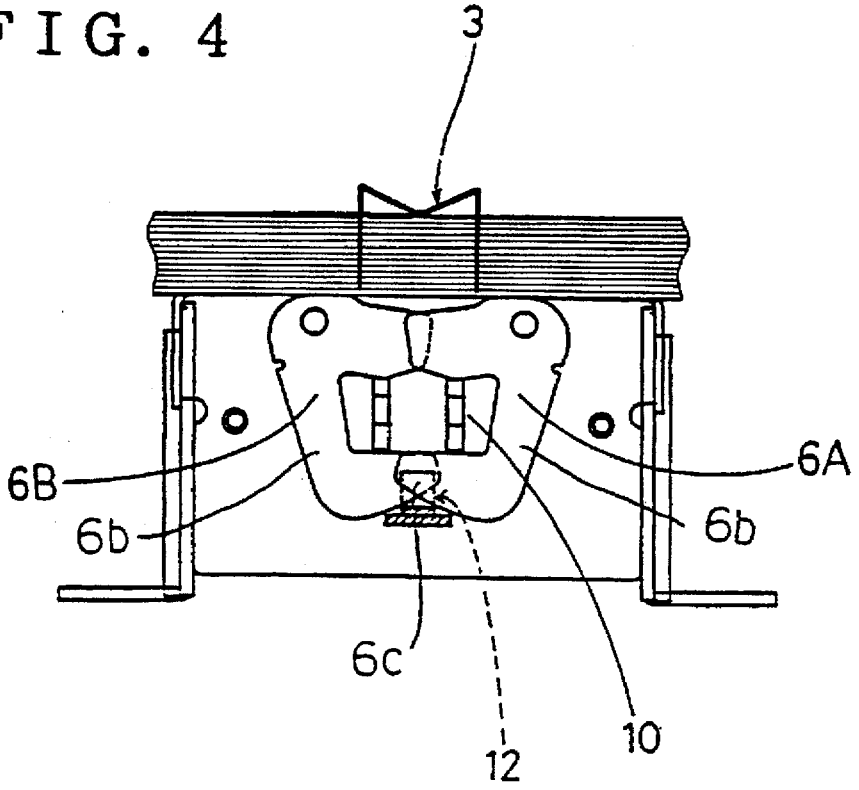
FIG. 4 is an example showing how the detecting mechanism works when a staple is imperfectly driven into sheets of paper.
Figure 5:
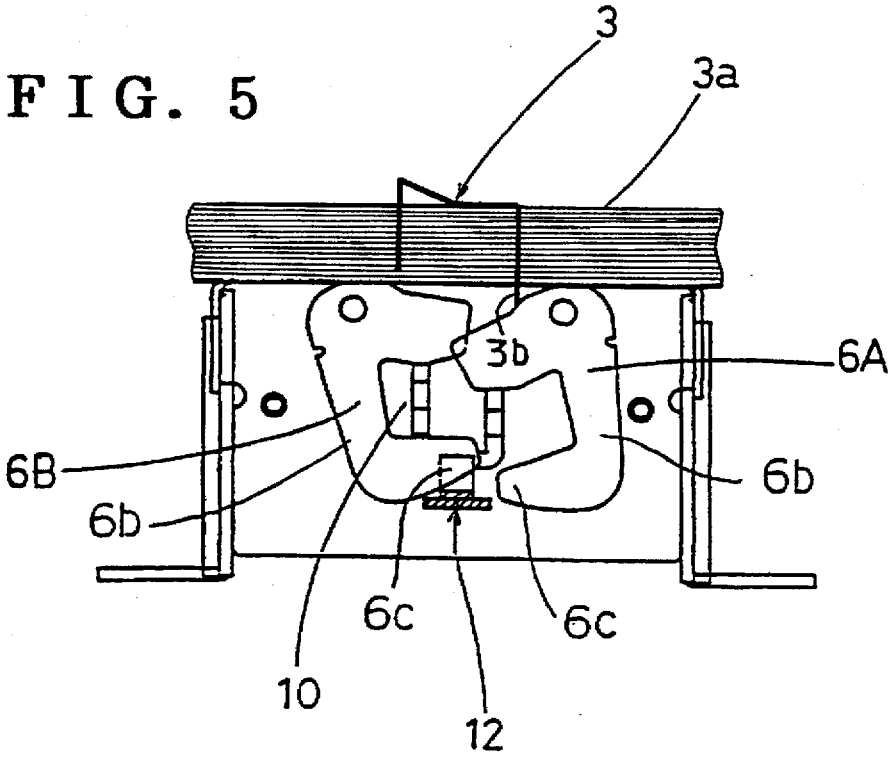
FIG. 5 is another example showing how the detecting mechanism works when a staple is imperfectly driven into the sheets.

If the staple 3 is bent into an M-shape as shown in FIG. 4 and therefore the legs 3*a* of the staple 3 cannot be driven through the sheets 2 or, as shown in FIG. 5, only one of the legs 3*a* is driven therethrough, both the clinchers 6A, 6B cannot be rotated or only one of the clinchers 6A, 6B can be rotated. In this case, at least one of the ends 6*c* of the clinchers 6A, 6B keeps intercepting the beam of light emitted by the light emitting diode 12*a* and accordingly the photosensor 12 does not detect that the legs 3*a* of the staple 3 have been normally driven through the sheets 2.

Accordingly, since a detection signal is not sent out which shows that stapling is normally carried out during one cycle of stapling, abnormality in stapling is detected. Accordingly, since the driver 8 is not actuated, stapling is stopped.

On the condition that a beam of light emitted by the light emitting diode 12*a* is intercepted (i.e., the ends 3*b* of the legs 3*a* of the staple 3 have been normally clinched), the photosensor 12 may output a detection signal of normality in stapling after the photodiode 12*b* outputs a light-reception signal which shows that the legs 3*a* of the staple 3 has been normally driven through the sheets 2. In addition, the position of the photosensor 12 is not limited to that indicated above. For example, a plurality of photosensors 12 may be disposed at places indicated by the broken lines in FIG. 1(*a*), respectively.

What is claimed is:

1. A detecting mechanism of an electric stapler for detecting an abnormal state in which sheets of paper are not normally fastened together with staples, said detecting mechanism comprising:

a stapling base on which sheets of paper are laid, said stapling base having an opening for receiving ends of legs of a staple which have been driven through the sheets;

a pair of movable clinchers rotatably mounted under the opening; and a driver for rotating each of said clinchers in a predetermined direction so as to press and clinch the ends of the legs;

wherein said clinchers are each rotated in a direction opposite to the predetermined direction when the ends of the legs of the staple have been driven through the sheets, and a detecting means is provided for detecting rotation of said clinchers when said clinchers are each rotated in the opposite direction.

2. The detecting mechanism of claim 1, wherein a plurality of detecting means are provided for detecting the rotation of said clinchers in the opposite direction.

3. The detecting mechanism of claim 1, wherein said detecting means each comprise a photosensor.

4. The detecting mechanism of claim 1, wherein said clinchers each have an overlapping part, the overlapping part of one of said clinchers being lapped over the overlapping part of the other one of said clinchers when said clinchers are not each rotated in the direction opposite to the predetermined direction, the overlapping parts of said clinchers going away from each other without being lapped over when said clinchers are each rotated in the direction opposite to the predetermined direction, and said detecting means detects lapping of the overlapping parts of said clinchers.

5. The detecting mechanism of claim 4, wherein said detecting means comprises a photosensor.

* * * * *